US009714535B2

(12) United States Patent
Natsui et al.

(10) Patent No.: US 9,714,535 B2
(45) Date of Patent: Jul. 25, 2017

(54) VEHICLE HAVING OPENING-CLOSING CONTROL FUNCTION

(71) Applicant: Fuji Jukogyo Kabushiki Kaisha, Tokyo (JP)

(72) Inventors: Hiroshi Natsui, Tokyo (JP); Isao Itoi, Tokyo (JP); Hiroyuki Kobayashi, Tokyo (JP); Noriyasu Tanaka, Tokyo (JP); Tetsuro Takahashi, Tokyo (JP); Hiroaki Fujino, Tokyo (JP); Naoto Watanabe, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 14/619,426

(22) Filed: Feb. 11, 2015

(65) Prior Publication Data

US 2015/0233167 A1 Aug. 20, 2015

(30) Foreign Application Priority Data

Feb. 20, 2014 (JP) ..... 2014-030837

(51) Int. Cl.
*E05F 15/00* (2015.01)
*E05F 15/70* (2015.01)

(52) U.S. Cl.
CPC ..... *E05F 15/70* (2015.01); *E05Y 2400/358* (2013.01); *E05Y 2400/44* (2013.01); *E05Y 2800/12* (2013.01); *E05Y 2900/546* (2013.01)

(58) Field of Classification Search
CPC ..... E05F 15/70; E05F 15/71
USPC ..... 701/49
See application file for complete search history.

(56) References Cited

U.S. PATENT DOCUMENTS 7,438,346 B1 * 10/2008 Breed ..... E05C 17/203 296/146.12
2006/0214465 A1 * 9/2006 Chau ..... B60J 11/00 296/136.1

FOREIGN PATENT DOCUMENTS

| | | | |
|---|---|---|---|
| JP | 2005-225443 | | 8/2005 |
| JP | 2008-180013 | * | 8/2008 |
| JP | 2010-064743 | * | 3/2010 |

* cited by examiner

*Primary Examiner* — Muhammad Shafi
(74) *Attorney, Agent, or Firm* — Troutman Sanders LLP

(57) ABSTRACT

A vehicle such as an automobile includes: a vehicle body having an opening; an opening-closing member that closes the opening; a drive member that drives the opening-closing member so as to open and/or close the opening; a controller that controls the drive member to control the opening-closing member between a fully open position and a fully closed position; and an elastic member provided at a mating portion of the closed opening-closing member and the vehicle body and inserted between the closed opening-closing member and the vehicle body. The controller controls the drive member in a stopping state of the vehicle and opens the opening-closing member from the fully closed position so as to reduce a pressure acting upon the elastic member.

12 Claims, 5 Drawing Sheets

VEHICLE HAVING OPENING-CLOSING CONTROL FUNCTION

CROSS-REFERENCE TO RELATED APPLICATIONS

The present application claims priority from Japanese Patent Application No. 2014-030837 filed on Feb. 20, 2014, the entire contents of which are hereby incorporated by reference.

BACKGROUND

1. Technical Field

The present invention relates to a vehicle having an opening-closing control function.

2. Related Art

In a vehicle such as an automobile, an opening-closing member such as a rear gate is provided to be capable of opening and closing with respect to the vehicle body (Japanese Unexamined Patent Application Publication (JP-A) Nos. 2005-225443 and 2010-064743). A user opens the rear gate, for example, to load/unload luggage to/from the vehicle. Further, the user closes the opened rear gate.

In JP-A No. 2010-064743, an electromagnetic clutch which is used to enable automatic opening-closing of a vehicle door, such as the rear gate, is connected when the vehicle door is in a closed state, including when the vehicle is running, and abnormal noise caused by parts such as gears of a vehicle door drive system is suppressed.

Where an opening in a vehicle body is thus closed using an opening-closing member such as the rear gate, an elastic member which is called a weather strip is provided between the closed opening-closing member and the vehicle body to close a gap therebetween. Waterproofing and soundproofing are thus ensured.

However, since the elastic member which is thus inserted between the closed opening-closing member and the vehicle body is allowed to stay in a compressed state for a long time, the performance thereof can degrade with the passage with time. Where the performance of the elastic member degrades, waterproofing and soundproofing performance is degraded.

In particular, where the strength of the elastic member is used to ensure a predetermined gap between the opening-closing member and the vehicle body, in addition to preventing the inflow/outflow of the external air by disposing the elastic member between the closed opening-closing member and the vehicle body, since the elastic member deforms with the passage of time, the opening-closing member can vibrate and strike the vehicle body as the vehicle runs, thereby generating abnormal noise.

Thus, in a vehicle such as an automobile, there is a potential need for suppressing the performance degradation of the elastic member inserted between the opening-closing member and the vehicle body.

SUMMARY OF THE INVENTION

A vehicle having an opening-closing control function in accordance with the present invention includes a vehicle body having an opening; an opening-closing member that closes the opening; a drive member that drives the opening-closing member so as to open and/or close the opening; a controller that controls the drive member to control the opening-closing member between a fully open position and a fully closed position; and an elastic member provided at a mating portion of the closed opening-closing member and the vehicle body, and inserted between the closed opening-closing member and the vehicle body. The controller controls the drive member in a stopping state of the vehicle body and opens the opening-closing member from the fully closed position so as to reduce a pressure acting upon the elastic member.

The controller may open the opening-closing member from the fully closed position when detecting that the vehicle body is in the stopping state continuously more than a predetermined time period.

When opening the opening-closing member from the fully closed position, the controller may open the opening-closing member to a position which is more open than the fully closed position and in which a lock of the opening-closing member is not released, or to a position which is more open than the fully closed position and in which waterproofing at the mating portion of the opening-closing member and the vehicle body is maintained.

The vehicle may have a torque sensor that detects a drive torque of the opening-closing member created by the drive member. When opening the opening-closing member from the fully closed position, the controller may control the drive member until it is determined that the torque detected by the torque sensor is lower than a torque necessary for controlling the opening-closing member to the fully closed position.

The vehicle may have a position sensor that detects a position of the opening-closing member. When opening the opening-closing member from the fully closed position, the controller may control the drive member until it is determined, on the basis of the detection of the position sensor, that the position of the opening-closing member has shifted from the fully closed position.

DETAILED DESCRIPTION

An example of the present invention is described below with reference to the drawings.

Figure 1:
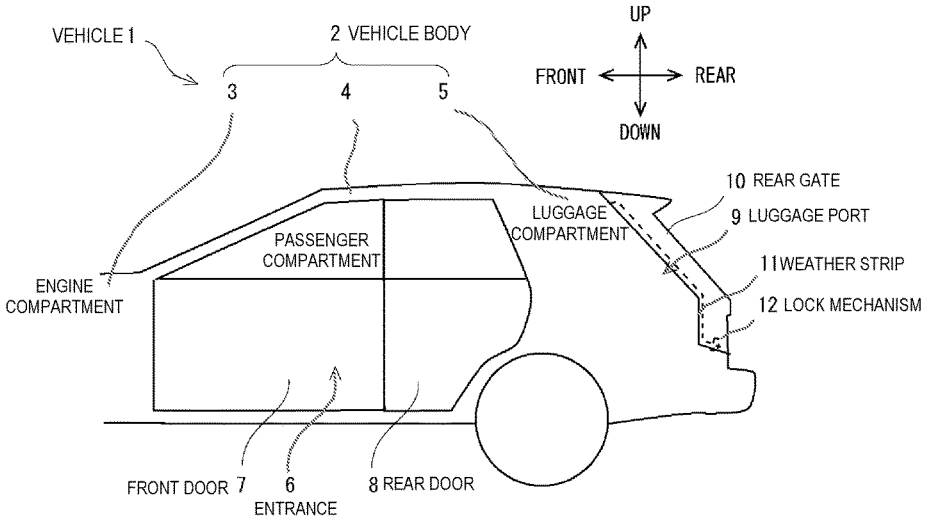
FIG. 1 is a partial explanatory drawing illustrating a fully closed state of a rear gate in the automobile according to an example of the present invention.
Figure 2:
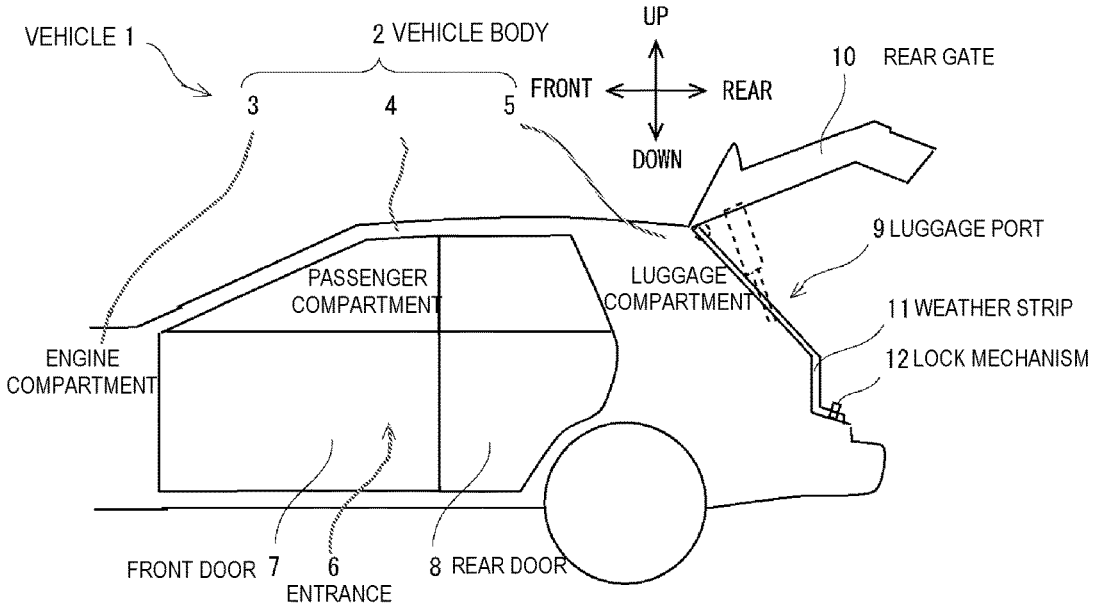
FIG. 2 is a partial explanatory drawing illustrating a fully open state of the rear gate in the automobile depicted in FIG. 1.

FIGS. 1 and 2 are partial explanatory drawings illustrating a vehicle 1 according to the example of the present invention.

FIG. 1 illustrates a fully closed state of a rear gate 10 of the vehicle 1. FIG. 2 illustrates a fully open state of the rear gate 10 of the vehicle 1.

The vehicle 1 depicted in FIG. 1 has a vehicle body 2. The vehicle body 2 is formed by combining skeleton members and panels. An engine compartment 3, a passenger compartment 4, and a luggage compartment 5 are provided in the vehicle body 2. The vehicle body 2 is a two-box type body, in which the passenger compartment 4 and the luggage compartment 5 communicate with each other.

An entrance 6 for getting on and off the passenger compartment 4 is formed in the side surface of the vehicle body 2. An openable-closeable front door 7 and an openable-closeable rear door 8 are attached to the side surface of the vehicle body 2. The entrance 6 is closed by closing the front door 7 and the rear door 8.

A luggage port 9 for loading a luggage into the luggage compartment 5 is provided at the rear part of the vehicle body 2. The openable-closeable rear gate 10 is attached to the rear part of the vehicle body 2. The luggage port 9 is closed by closing the rear gate 10.

FIG. 1 depicts a state in which the rear gate 10 is fully closed. FIG. 2 depicts a state in which the rear gate 10 is fully open. The former state will be referred to hereinbelow as a fully closed position of the rear gate 10, and the latter state will be referred to hereinbelow as a fully open position of the rear gate 10. The rear gate 10 moves to the fully open position when pulled up from the fully closed position, and moves to the fully closed position when pushed down from the fully open position.

A user opens the rear gate 10, for example, to load/unload a luggage to/from the vehicle body 2. The user also closes the opened rear gate 10.

Further, as depicted in FIG. 2, a weather strip 11 and a lock mechanism 12 of the rear gate 10 are disposed at the mating surface with the closed rear gate 10 in the rear part of the vehicle body 2. Further, a damper member for holding the rear gate 10 at the open position is provided between the rear gate 10 and the vehicle body 2.

The weather strip 11 is formed from an elastic material such as rubber or urethane. The weather strip 11 is formed along the entire periphery of the luggage port 9.

The weather strip 11 is inserted between the closed rear gate 10 and the vehicle body 2 to close a gap therebetween. The external air cannot flow in/out from the periphery of the rear gate 10. As a result, waterproofing and soundproofing are ensured.

Further, the weather strip 11 also forms a constant spacing between the rear gate 10 and the vehicle body 2 so as to prevent the closed rear gate 10 from striking the vehicle body 2, as the vehicle travels, by the strength (elastic reaction force) demonstrated by the weather strip during elastic deformation. The occurrence of abnormal noise caused by the closed rear gate 10 shaking and striking the vehicle body 2 as the vehicle travels is thus prevented.

The lock mechanism 12 is disposed, for example, at a location under the luggage port 9. The rear gate 10 rotates up-down, with the upper end thereof serving as a base end. The lock mechanism 12 engages with a free end of the rear gate 10 rotated down. As a result, the rear gate 10 is prevented from opening as the vehicle travels.

However, since the weather strip 11 is formed from an elastic material and allowed to stay for a long time in a compressed state, the weather strip may deform or the performance thereof may degrade over time. Where the performance of the weather strip 11 is degraded, waterproofing and soundproofing performance thereof is degraded. Further, where the weather strip 11 deforms, the closed rear gate 10 may shake and strike the vehicle body 2 as the vehicle travels, whereby abnormal noise may occur even though the weather strip 11 is provided.

Accordingly, the present example suppresses performance degradation of the elastic member inserted between the opening-closing member, such as the weather strip 11, and the vehicle body 2. This is described hereinbelow in greater detail.

Figure 3:
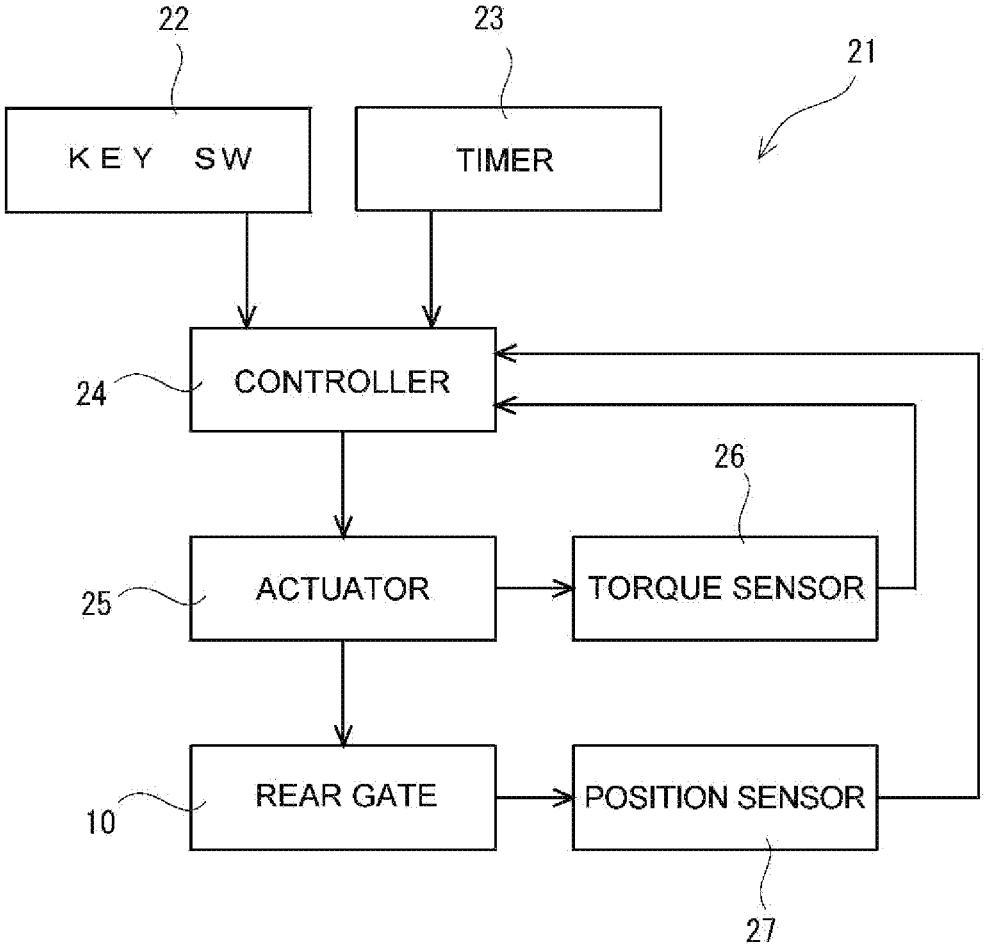
FIG. 3 is an explanatory drawing illustrating an opening-closing control device for the rear gate provided in the automobile depicted in FIG. 1.

FIG. 3 is an explanatory drawing illustrating an opening-closing control device 21 of the rear gate 10 provided at the automobile 1 depicted in FIG. 1.

The opening-closing control device 21 depicted in FIG. 3 has an ignition key switch (KEY SW) 22, a timer 23, a controller 24, an actuator 25, a torque sensor 26, and a position sensor 27 in order to control the opening and closing of the rear gate 10.

Further, the opening-closing control device 21 depicted in FIG. 3 can also function, for example, as a so-called auto-closure device for the rear gate 10 that open/close drives the rear gate 10 between the fully closed position and the fully open position.

The actuator 25 drives the rear gate 10 so as to open and close. The actuator 25 may be formed, for example, by a motor.

The position sensor 27 detects the position of the rear gate 10 from the fully closed position to the fully open position. The position sensor 27 may be formed, for example, by a rotary encoder detecting the rotation amount of a rotating shaft of the rear gate 10.

The torque sensor 26 detects the drive torque of the actuator 25. The torque sensor 26 may be formed, for example, by a torque detection member integrated with the actuator 25.

The ignition key switch 22 is operated for starting the engine before the vehicle 1 is caused to run.

The timer 23 measures the timing and elapsed time.

Those ignition key switch 22, timer 23, actuator 25, torque sensor 26, and position sensor 27 are connected to the controller 24.

The controller 24 may be, for example, an engine control unit (ECU) or other computer devices mounted on the automobile 1. The controller 24 directly controls the actuator 25 to control the rear gate 10 between the fully open position and fully closed position. In particular, in the present example, the rear gate 10 is controlled not only to the fully open position and fully closed position, but also to a slightly open position in which the rear gate is slightly open from the fully closed position.

Figure 4:
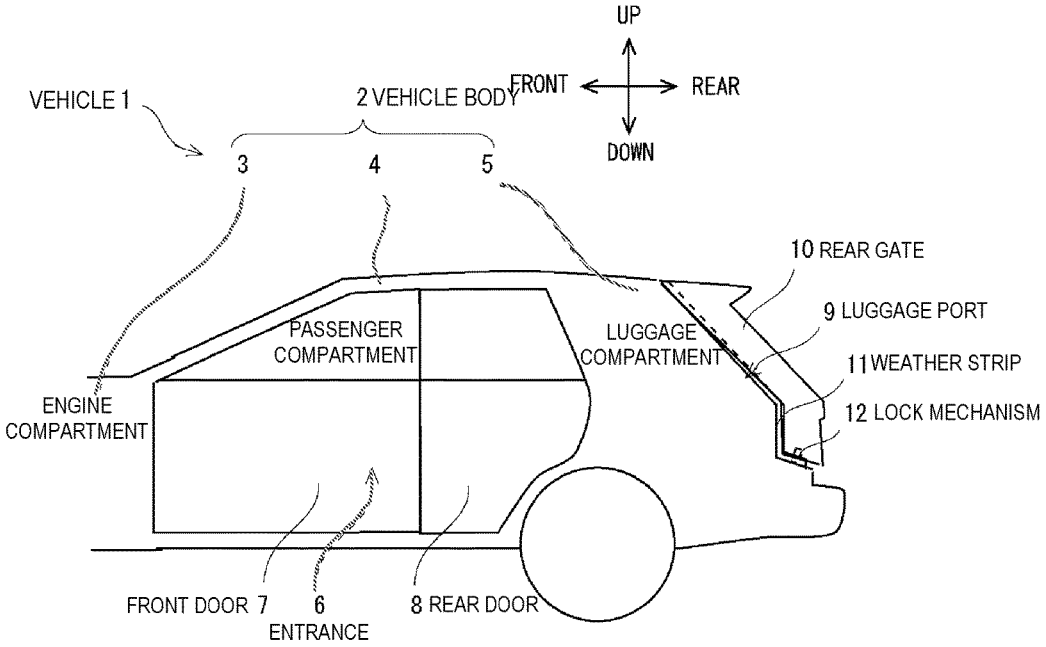
FIG. 4 is a partial explanatory drawing illustrating a slightly open state of the rear gate in the automobile depicted in FIG. 1.

FIG. 4 is a partial explanatory drawing illustrating the state in which the rear gate 10 is slightly open in the vehicle 1 depicted in FIG. 1.

As depicted in FIG. 4, where the rear gate 10 is controlled to the slightly-open position, the rear gate 10 is slightly raised from the vehicle body 2.

As a result, the pressure acting upon the weather strip 11 that is inserted between the rear gate 10 and the vehicle body 2 and is compressed and deformed is greatly reduced compared to when the rear gate 10 is in the fully closed position. Thus, the weather strip 11 is not continuously compressed by a strong force.

However, in this open position obtained by opening from the fully closed position, the rear gate 10 is not open to a greater degree because the locking ensured by the lock mechanism 12 is not released. Further, although a slight gap is formed between the rear gate 10 and the vehicle body 2, this gap is closed by the weather strip 11. Thus, the weatherproofing and security of the rear gate 10 are not lost even in the open position which is opened from the fully closed position.

Figure 5:
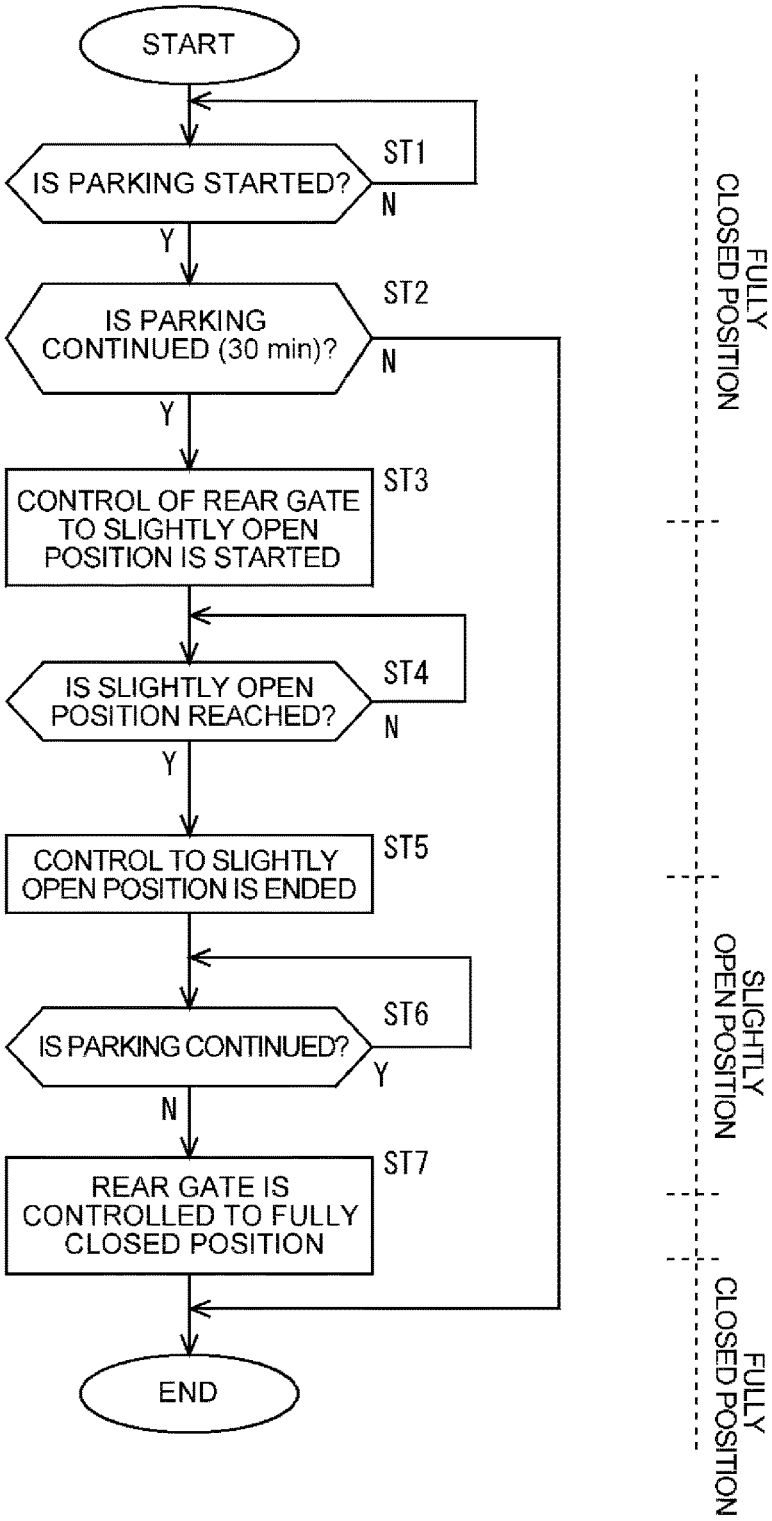
FIG. 5 is a flowchart for controlling the slightly open position of the rear gate with the controller depicted in FIG. 3.

FIG. 5 is a flowchart for controlling the rear gate 10 to the slightly open position with the controller 24 depicted in FIG.

3. A vertical timeline with the time flowing from top to bottom is depicted on the right side of the flowchart.

The controller 24 repeatedly executes, each time the automobile 1 is parked, the control flowchart depicted in FIG. 5. The controller 24 executes the control flowchart depicted in FIG. 5 while the automobile 1 is parked and not run.

As depicted in FIG. 5, the controller 24 initially determines whether or not the automobile 1 has started to be parked (step ST1). The controller 24 determines that the automobile 1 has been parked, for example, on the basis of the ignition key switch 22 being set OFF and the engine being stopped. Alternatively, for example, the controller 24 may determine that the automobile 1 has been parked on the basis of a key lock (not depicted in the figure) being closed.

Then, the controller 24 then determines whether or not the vehicle body 2 is continuously parked (step ST2). For example, the controller 24 repeatedly examines whether there is no change in the parking state until the time elapsed since the determination of step ST1, which is measured by the timer 23, exceeds a predetermined determination time (for example, 30 minutes). Where the parking state has not changed until the elapsed time exceeds the determination time, the vehicle body 2 is determined to be parked continuously. In other cases, the vehicle body 2 is determined not to be parked continuously, and the processing is ended.

Where the vehicle body 2 is determined to be parked continuously, the controller 24 starts the control for moving the rear gate 10 which is at the fully closed position to the slightly open position (step ST3). The controller 24 controls the actuator 25. Further, the controller 24 determines whether or not the rear gate 10 has reached the slightly open position (step ST4). Where the rear gate 10 moves to the slightly open position, the controller 24 ends the control leading to the slightly open position with the actuator 25 (step ST5).

For example, the controller 24 controls the actuator 25 until the torque detected by the torque sensor 26 is determined to be less than a predetermined torque at the time of slight opening, which is less than the torque at the time of full closing that is necessary for controlling the rear gate 10 to the fully closed position.

In addition, for example, the controller 24 controls the actuator 25 until the position of the rear gate 10 is determined to be a predetermined slightly open position a little shifted from the fully closed position on the basis of the detection performed by the position sensor 27.

As a result, when the automobile 1 is parked continuously, the rear gate 10 is controlled from the fully closed position to the slightly open position.

After the rear gate 10 has been controlled to the slightly open position, the controller 24 starts continuously the processing for returning the rear gate 10 from the slightly open position to the fully closed position. For example, the controller 24 determines whether or not the vehicle is further parked continuously equal to or more than a predetermined time period, for example 30 minutes (step ST6). The determination whether or not the vehicle is parked continuously herein may be the same as in step ST2.

Then, where the vehicle is parked continuously, the controller 24 repeats step ST6 to determine whether or not the vehicle is parked continuously, without executing the control of the actuator 25. As a result, the rear gate 10 is continuously maintained at the slightly open position in the parking state.

On the other hand, where the vehicle is not parked continuously, the controller 24 starts the control for returning the rear gate 10 from the slightly open position to the fully closed position (step ST7). The controller 24 controls the actuator 25 so as to return the rear gate 10 from the slightly open position to the fully closed position. As a result, the rear gate 10 is closed. The weather strip 11 is compressed between the rear gate 10 and the vehicle body 2, and high waterproofing performance of the rear gate 10 is demonstrated even when the vehicle runs.

As indicated at the timeline on the right side of the flowchart in FIG. 5, when the vehicle is parked continuously, the rear gate 10 is controlled from the fully closed position to the slightly open position, and the rear gate 10 can be maintained at the slightly open position. Further, when the parking is ended, the rear gate 10 can be returned to the usual fully closed position.

As indicated hereinabove, in the present example, while the vehicle 1 is parked, the controller 24 controls the actuator 25, opens the rear gate 10 from the fully closed position, and reduces the pressure acting upon the weather strip 11. Therefore, the pressure acting upon the weather strip 11 while the vehicle body 2 is parked is reduced and the temporal deformation and performance degradation of the weather strip 11 can be suppressed. The progression in the deformation and performance degradation of the weather strip 11 during long-term parking can be effective suppressed.

As a result, this example can suppress the performance degradation and deformation of the weather strip 11 inserted between the rear gate 10 and the vehicle body 2 and maintain the original high waterproofing and soundproofing performance can over a long period of time.

In particular, since the weather strip 11 is difficult to be deformed, it is possible not only to prevent the inflow and outflow of the external air by simply disposing the weather strip 11 between the closed rear gate 10 and the vehicle body 2, but also to maintain for a long time the state in which the rear gate 10 does not strike the vehicle body 2 as the vehicle runs and prevent the occurrence of abnormal noise caused by such strikes while a constant gap is ensured between the rear gate 10 and the vehicle body 2 by using the strength of the weather strip 11.

In the present example, the rear gate 10 is opened from the fully closed position after the vehicle has been continuously parked. Therefore, the number of times the rear gate 10 is opened from the fully closed position can be reduced compared to the case in which the rear gate is opened from the fully closed position immediately after the vehicle has been parked. As a result, it is possible not to perform the unnecessary slight opening control when the vehicle is parked for a short time, that is, when a significant effect of suppressing the temporal deformation and performance degradation of the weather strip 11 is unlikely to be obtained. Thus, the waste of electric power stored in the vehicle battery can be reduced without losing the effect of suppressing the temporal deformation and performance degradation of the weather strip 11.

In the present example, the rear gate 10 is opened to a slightly open position, and in this position, the lock of the rear gate 10 is not released and waterproofing performance is maintained. As a result, the deformation and temporal performance degradation of the weather strip 11 can be suppressed while maintaining the security and waterproofing at the same level as the case in which the rear gate 10 is not controlled to the slightly open position while the vehicle is parked.

In the present example, for example, the actuator 25 is controlled and the rear gate 10 is open until it is determined, on the basis of the torque detected by the torque sensor 26, that the torque is lower than that necessary for controlling the rear gate 10 to the fully closed position. As a result, the weather strip 11 is not maintained in a state of being compressed by a strong torque while the vehicle is parked, and the temporal deformation and performance degradation of the weather strip 11 can be suppressed.

Further, in the present example, for example, the actuator 25 is controlled and the rear gate 10 is opened until it is determined, on the basis of the detection by the position sensor 27, that the position of the rear gate 10 has shifted from the fully closed position. As a result, the weather strip 11 is not maintained in a state of being compressed by a strong torque, as in the case in which the rear gate 10 is held at a fully closed position while the vehicle is parked, and the temporal deformation and performance degradation of the weather strip 11 can be suppressed.

The present invention is not limited the example described above, and various changes and modifications can be made without departing from the scope of the invention.

For example, in the above-described example, the controller 24 controls the rear gate 10 to the slightly open position after the vehicle has been continuously parked for a predetermined time. Alternatively, for example, the controller 24 may control the rear gate 10 to the slightly open position after the vehicle has been stopped.

Further, the controller 24 may control, as appropriate, the rear gate 10 to the slightly open position for a period of time other than that of parking or stopping, for example, any period of time in which the vehicle does not run.

The controller 24 may also control an opening-closing member other than the rear gate 10, for example, the front door 7, the rear door 8, and a trunk door, to the slightly open position while the vehicle is stopped.

In the example described above, the present invention is applied to the automobile equipped with an engine. The present invention may be also applied to other vehicles such as an electric vehicle, a hybrid vehicle, a large-size automobile, and a lightweight vehicle. The temporal performance degradation and deformation of the elastic member such as the weather strip 11 can be also suppressed in those cases.

The invention claimed is:

1. A vehicle providing an opening-closing control function, the vehicle comprising:

a vehicle body including an opening;

an opening-closing member that closes the opening;

a drive member that drives the opening-closing member so as to open or close the opening;

a controller that controls the drive member to control the opening-closing member between a fully open position and a fully closed position; and an elastic member provided at a mating portion of the closed opening-closing member and the vehicle body, and inserted between the closed opening-closing member and the vehicle body, wherein the controller, while the vehicle is stopped, is configured to drive the opening-closing member from the fully closed position to a slightly open position in which waterproofing at the mating portion of the opening-closing member and the vehicle body is maintained by the elastic member and the controller is configured to maintain the opening-closing member at the slightly open position, so as to reduce a compression of the elastic member.

2. The vehicle providing an opening-closing control function according to claim 1, wherein the controller is configured to drive the opening-closing member from the fully closed position to the slightly open position when detecting that the vehicle is stopped continuously for more than a predetermined time period.

3. The vehicle providing an opening-closing control function according to claim 2, wherein when opening the opening-closing member from the fully closed position to the slightly open position, the controller is configured to drive the opening-closing member to the slightly open position comprising a predetermined stroke in the opening direction from the fully closed position and in which a lock of the opening-closing member is not released.

4. The vehicle providing an opening-closing control function according to claim 3, further comprising:

a torque sensor that detects a drive torque of the opening-closing member created by the drive member, wherein when opening the opening-closing member from the fully closed position to the slightly open position, the controller is configured to drive the drive member until it is determined that the torque detected by the torque sensor is lower than a torque necessary for controlling the opening-closing member to the fully closed position.

5. The vehicle providing an opening-closing control function according to claim 3, further comprising:

a position sensor that detects a position of the opening-closing member, wherein when opening the opening-closing member from the fully closed position to the slightly open position, the controller is configured to drive the drive member until it is determined, on the basis of the detection of the position sensor, that the position of the opening-closing member has shifted from the fully closed position.

6. The vehicle providing an opening-closing control function according to claim 2, further comprising:

a torque sensor that detects a drive torque of the opening-closing member created by the drive member, wherein when opening the opening-closing member from the fully closed position to the slightly open position, the controller is configured to drive the drive member until it is determined that the torque detected by the torque sensor is lower than a torque necessary for controlling the opening-closing member to the fully closed position.

7. The vehicle providing an opening-closing control function according to claim 2, further comprising:

a position sensor that detects a position of the opening-closing member, wherein when opening the opening-closing member from the fully closed position to the slightly open position, the controller is configured to drive the drive member until it is determined, on the basis of the detection of the position sensor, that the position of the opening-closing member has shifted from the fully closed position.

8. The vehicle providing an opening-closing control function according to claim 1, wherein when opening the opening-closing member from the fully closed position to the slightly open position, the controller is configured to drive the opening-closing member to the slightly open position comprising a predetermined stroke in the opening direction from the fully closed position and in which a lock of the opening-closing member is not released.

9. The vehicle providing an opening-closing control function according to claim 8, further comprising:

a torque sensor that detects a drive torque of the opening-closing member created by the drive member, wherein when opening the opening-closing member from the fully closed position to the slightly open position, the controller is configured to drive the drive member until it is determined that the torque detected by the torque sensor is lower than a torque necessary for controlling the opening-closing member to the fully closed position.

10. The vehicle providing an opening-closing control function according to claim 8, further comprising:

a position sensor that detects a position of the opening-closing member, wherein when opening the opening-closing member from the fully closed position to the slightly open position, the controller is configured to drive the drive member until it is determined, on the basis of the detection of the position sensor, that the position of the opening-closing member has shifted from the fully closed position.

11. The vehicle providing an opening-closing control function according to claim 1, further comprising:

a torque sensor that detects a drive torque of the opening-closing member created by the drive member, wherein when opening the opening-closing member from the fully closed position to the slightly open position, the controller is configured to drive the drive member until it is determined that the torque detected by the torque sensor is lower than a torque necessary for controlling the opening-closing member to the fully closed position.

12. The vehicle providing an opening-closing control function according to claim 1, further comprising:

a position sensor that detects a position of the opening-closing member, wherein when opening the opening-closing member from the fully closed position to the slightly open position, the controller is configured to drive the drive member until it is determined, on the basis of the detection of the position sensor, that the position of the opening-closing member has shifted from the fully closed position.

* * * * *